US005139725A

United States Patent [19]

Specker et al.

[11] Patent Number: 5,139,725

[45] Date of Patent: Aug. 18, 1992

[54] PROCESS FOR MANUFACTURE OF CRIMPED POLYESTER YARN FROM COLD DRAWN POLYESTER-POY YARN

[75] Inventors: Hugo Specker, Sempach; Paul Schaffner, Kriens, both of Switzerland

[73] Assignee: Rhone-Poulenc Viscosuisse S.A., Emmenbruke, Switzerland

[21] Appl. No.: 439,125

[22] Filed: Nov. 17, 1989

Related U.S. Application Data

[62] Division of Ser. No. 642,919, filed as PCT/CH83/00138, Dec. 8, 1983, Pat. No. 4,908,269.

[30] Foreign Application Priority Data

Dec. 17, 1982 [CH] Switzerland ..... 7354/824

[51] Int. Cl.[5] ..... D01D 5/12

[52] U.S. Cl. ..... 264/168; 264/210.7; 264/210.8; 264/211.15; 264/234; 264/289.6; 264/290.5; 264/342 RE; 264/345

[58] Field of Search ..... 264/168, 210.8, 210.7, 264/211.15, 289.6, 290.5, 290.7, 234, 342 RE, 345

[56] References Cited

U.S. PATENT DOCUMENTS

| | | | |
|---|---|---|---|
| 2,177,637 | 10/1939 | Coffman | 264/168 |
| 2,249,756 | 7/1941 | Finzel | 264/168 |
| 2,730,758 | 1/1956 | Morrell et al. | 264/168 |
| 2,734,794 | 2/1956 | Calton | 264/168 |
| 2,758,908 | 8/1956 | Kolb | 8/130.1 |
| 2,931,068 | 4/1960 | Kitson et al. | 18/48 |
| 2,937,380 | 5/1960 | Reese | 2/275 |
| 2,952,879 | 9/1960 | Kitson et al. | 18/48 |
| 2,979,883 | 4/1961 | Waltz | 57/140 |
| 3,188,714 | 6/1965 | Spangler | 264/168 |
| 3,480,709 | 11/1969 | Jacob et al. | 264/168 |
| 3,680,301 | 8/1972 | Michel | 57/140 J |
| 3,691,748 | 9/1972 | Buzano | 57/140 J |
| 3,816,992 | 6/1974 | Frankfort et al. | 57/140 R |
| 3,953,962 | 5/1976 | Breen, deceased et al. | 57/140 R |
| 4,217,321 | 8/1980 | Campbell | 264/168 |
| 4,414,169 | 11/1983 | McClary | 264/210.7 |
| 4,571,793 | 2/1986 | Price | 264/289.6 |

FOREIGN PATENT DOCUMENTS

| | | |
|---|---|---|
| 0128908 | 3/1987 | European Pat. Off. . |
| 0941010 | 3/1956 | Fed. Rep. of Germany . |
| 1291852 | 4/1969 | Fed. Rep. of Germany . |
| 53-143728 | 12/1978 | Japan . |
| 8402357 | 6/1984 | PCT Int'l Appl. . |
| 1061774 | 3/1967 | United Kingdom . |

*Primary Examiner*—Hubert C. Lorin
*Attorney, Agent, or Firm*—Seidel, Gonda, Lavorgna & Monaco

[57] ABSTRACT

A process for the manufacture of a crimped polyester yarn obtained from a polyester partially-oriented yarn comprising fabricating a partially-oriented polyester yarn by a high-speed process, cooling the partially-oriented polyester yarn, cold drawing the cooled yarn, and subjecting the cold drawn polyester yarn to a thermal treatment under tensionless conditions or under controlled overfeed conditions.

10 Claims, 4 Drawing Sheets

PROCESS FOR MANUFACTURE OF CRIMPED POLYESTER YARN FROM COLD DRAWN POLYESTER-POY YARN

This is a divisional of co-pending application Ser. No. 06/692919 filed as PCT/CH83/00138, Dec. 8, 1983, Pat. No. 4,908,269.

FIELD OF THE INVENTION

The invention pertains to a crimped polyester yarn obtained from cold drawn polyester-POY (Partially Oriented Yarn), as well as a process for its manufacture, and the application of such yarns.

BACKGROUND OF THE INVENTION

German Patent DE-AS 1,291,852 (U.S. counterpart being U.S. Letters Pat. No. 2,979,883) pertains to a process for the manufacture of fibers, yarns or films from crystallizable polyester, by the following steps: (a) slow melt spinning, (b) subsequent warm drawing and (c) thermal shrinkage. The thus obtained fibers, yarns or films may be irreversibly lengthened by moderate heat treatment, without having a tension exerted thereon. Once lengthened, these fibers do not return on their original length by cooling and drying.

Moreover, Japanese Application 0 055 268 discloses the cold drawing of a polyester yarn in a draw ratio of 1.05–1.35, while the yarn is being spun at a rate ranging between 4000 and 7000 m/min. Notwithstanding the above references, the literature does not disclose the possibility of subjecting such yarns to aftertreatment processes.

SUMMARY OF THE INVENTION

The present invention pertains to a new yarn which is manufactured by the aftertreatment of a cold-drawn polyester-POY.

Specifically, the present invention pertains to a crimped polyester yarn, obtained from cold-drawn polyester-POY yarn, characterized in that the stress/-strain course between 10 and 30% elongation, resulting from the stretch test, corresponds to a secant modulus of 0–100%.

As used herein, the term "secant modulus" refers to the end value of a straight line, defined by the stress at 10 and 30% elongation, parallel shifted to stress 0 at elongation 0. The unity corresponds to the percentage portion of the breaking stress by 100% theoretical elongation. The definition of the term "secant modulus" will be further explained in relation with FIG. 1. Briefly, FIG. 1 shows a stress/strain diagram having a marked plateau zone between points 3 and 4. This plateau zone characterizes the yarn according to the present invention.

The yarns of the present invention are twistless and totally shrunk. Although twistless, these yarns are, nevertheless, crimped. The crimp imparted on the novel yarns is three dimensional, optically interesting and presents a fine appearance. Moreover, the crimp of the individual yarn fibrils is also irregular.

As used herein, the term "polyester-POY" refers to endless, cold-drawn yarns which are spun at a rate between 2000 and 5000 m/min. This cold-drawing process takes place at room temperature on a draw machine (e.g., a draw-twist or draw-wind machine) at a draw ratio ranging from 1.2 to 2.2. The denier of the individual yarn filaments is not critical.

The invention further pertains to a process for the manufacture of the above-mentioned crimped yarns, wherein the cold-drawn polyester-POY is subjected to a thermal treatment. This thermal treatment can be carried out in air, vapor or an inert liquid.

As used herein, the term "inert liquid" refers to a liquid which: (a) does not dissolve the polyester-POY, and (b) does not react with the polyester-POY. Water is a presently preferred "inert liquid", if such is employed. During this thermal treatment process, the cold-drawn polyester-POY shrinks substantially (i.e., up to 60%).

Although there is substantial shrinkage during the aforementioned thermal treatment process, the shrinkage force of the cold-drawn polyester-POY is, nevertheless, very small. Thus, the smallest stresses could reduce or even prevent the cold-drawn polyester-POY from shrinking. In view of relatively small shrinkage force, the thermal treatment of the polyester-POY is carried out: (a) under tensionless conditions, and/or (b) under controlled overfeed. If employed, the overfeed varies from between 20 and 100%, preferably, between 40 and 80%.

The thermal treatment of the cold-drawn polyester-POY preferably takes place in a "shocking way". The term "shocking way", when used to describe a particular thermal treatment process, refers to either a sudden, short-term warming up process of the yarn, or a process wherein the yarn is introduced into a warm bath.

One method of thermally treating the cold-drawn polyester-POY is by subjecting it to air which has been heated to a temperature of more than 80° C., preferably, to a temperature ranging between 140 and 220° C., while, simultaneously, subjecting the yarn to a controlled overfeed ranging between 20–100%, preferably, between 40–80%. A convection heater is especially useful for practicing this method of thermally treating the cold-drawn polyester-POY yarn.

If the thermal treatment is carried out by subjecting the yarn to steam or an inert liquid, the thermal treatment is maintained at a temperature of more than 60° C., preferably, at a temperature ranging from 90°–100° C. This thermal treatment will be carried out while the yarn is under tensionless conditions, and while the yarn is being subjected to a controlled overfeed ranging from 20–100%, preferably, from 40–80%. As used herein, the term "steam" refers to either saturated steam or overheated water steam.

The crimp of the yarn according to the present invention is irregular and stress sensitive. Accordingly, any further processing of the yarn should be carried out under a stress less than about 0.5 cN/dtex. This is possible or normally the case with all present knitting, weaving and warp-knitting machines.

The invention further pertains to employing the crimped yarn resulting from the process disclosed herein in conventional knitting, weaving and warp-knitting processes.

BRIEF DESCRIPTION OF THE DRAWINGS

The invention is more fully explained by referring to the figures briefly described below.

DETAILED DESCRIPTION OF THE INVENTION

Figure 1:
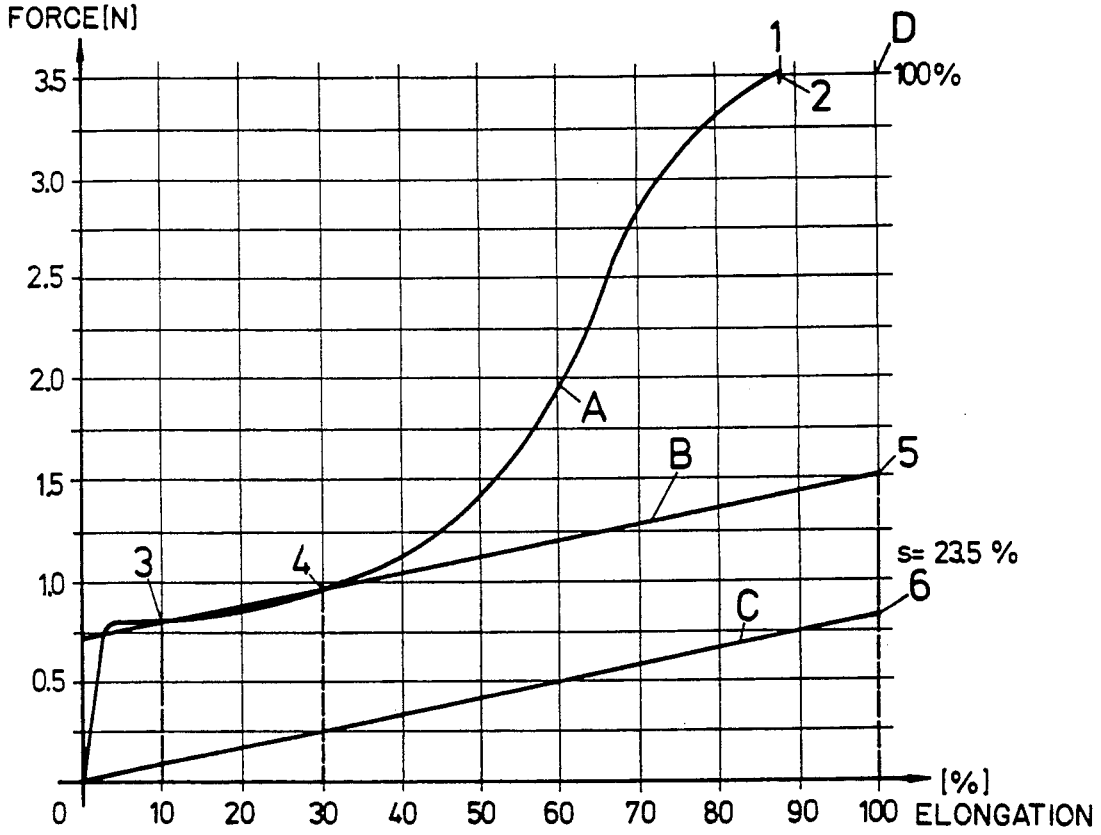
FIG. 1 is a stress/strain diagram of a yarn according to the invention, as well as the representation of the secant modulus and how it is determined.

FIG. 1 shows stress/strain curve A of a polyester yarn prepared in accordance with the present invention. This yarn is a half mat, round yarn, tested according to DIN 53834, first part.

Point 1 on curve A represents the breaking stress in Newtons. Point 2 on this same curve represents the breaking elongation in percentage.

The yarn is characterized by the plateau zone between points 3 and 4 on curve A. A straight line, B, is drawn between point 3, wherein elongation is 10%, and point 4, wherein elongation is 30%. Line B is extrapolated to the point where elongation is zero and the theoretical elongation of 100% (i.e., point 5).

In order to calculate the secant modulus of the yarn, line B is parallel shifted so that, when stress is zero, elongation is also zero. This parallel shifted line is identified as line C.

By looking at the point where line C intersects elongation at 100% (i.e., point 6), the secant modulus (s) of the yarn can be determined. Specifically, according to FIG. 1, the thus obtained stress by 100% theoretical elongation is calculated and is expressed as a percentage of the effective breaking stress (point D). In FIG. 1, the secant modulus (s) equals 23.5%.

Figure 2:
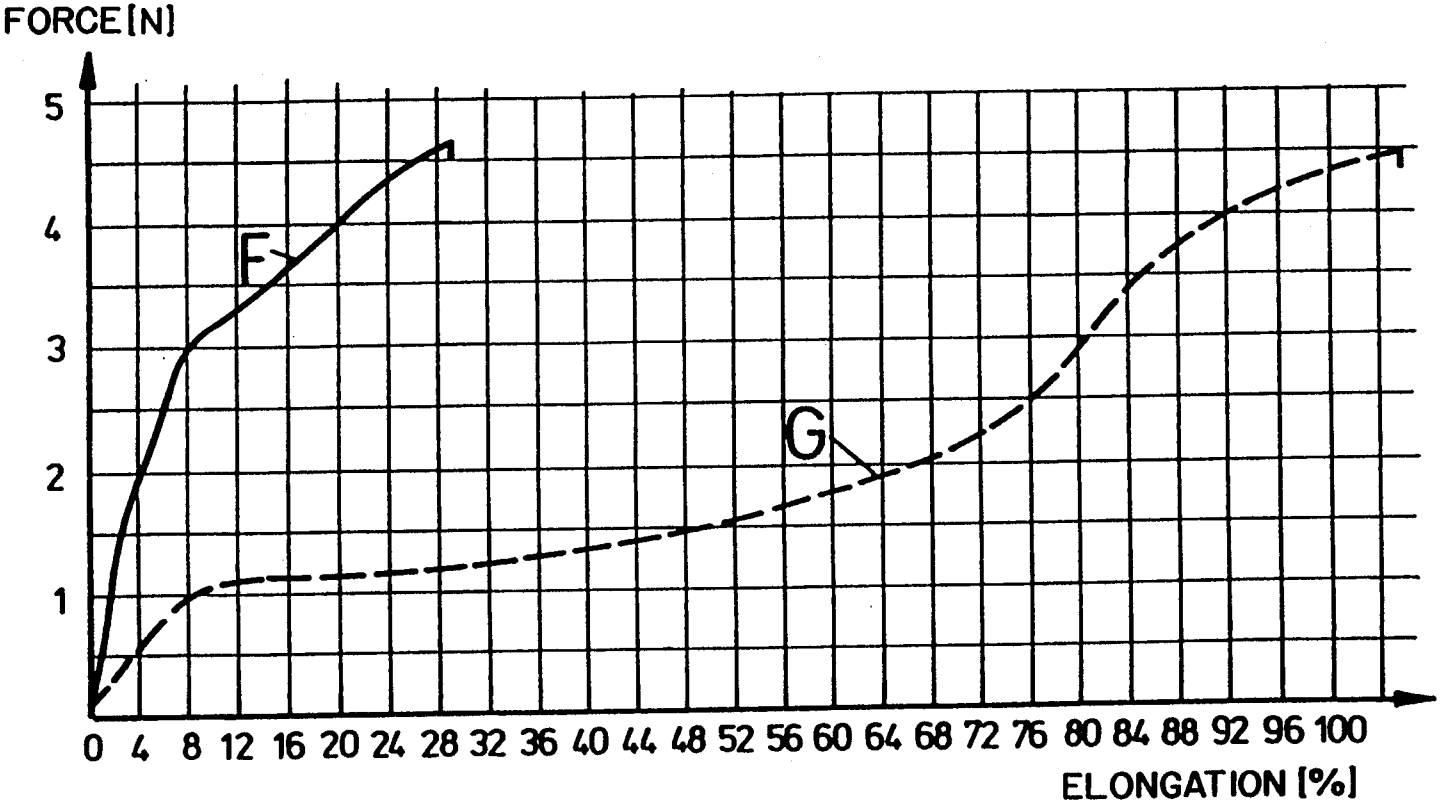
FIG. 2 is a stress/strain diagram of the raw material and of the yarn prepared in accordance with the present invention.

FIG. 2 shows curve F (i.e., stress/strain diagram of a cold-drawn polyester-POY), and curve G (i.e., a stress-strain diagram of a thermally treated cold-drawn polyester-POY). The thermal treatment took place and in a "shocking way", under tensionless conditions, and in warm water.

Figure 3:
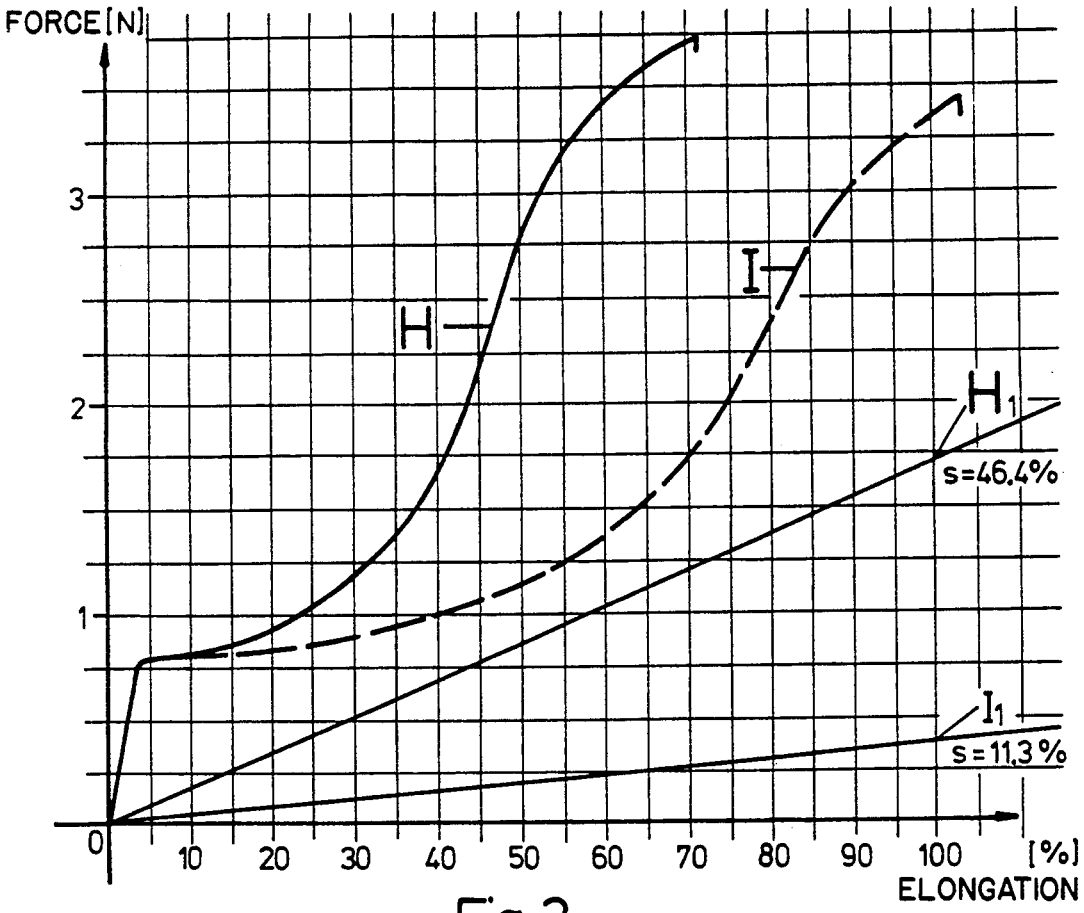
FIG. 3 is a stress/strain diagram of the raw material and of the yarn prepared in accordance with the present invention.

FIG. 3 shows curves H and I which are stress/strain diagrams of polyester yarns prepared in accordance with the invention. These yarns were thermally treated while being subjected to a 40% and 80% overfeed, respectively. Both tests took place with polyester yarns, half mat, round (denier of the cold-drawn polyester-POY dtex 84 f 15) at a temperature of 200° C. The heating device employed was a convection heater. The speed was at 110 m/min. Lines H and I , which correspond with curves H and I, respectively, give a value of the secant modulus where "s" equals 46.4% and 11.3%, respectively.

Figure 4A:
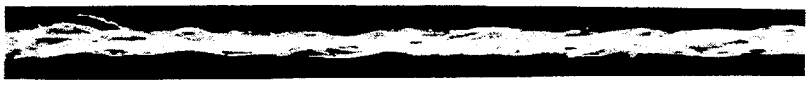
FIG. 4*a* is a photograph of a false twist textured yarn.
Figure 4B:
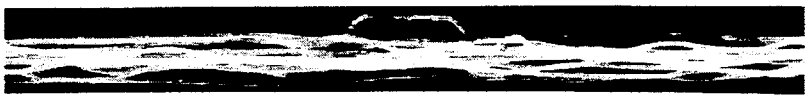
FIG. 4*b* is a photograph of a yarn prepared in accordance with the present invention.
Figure 4C:
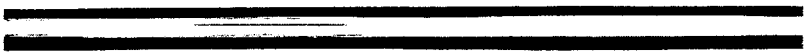
FIG. 4*c* is a photograph of a flat yarn.

FIG. 4*b* shows a yarn prepared in accordance with the present invention; FIG. 4*a* shows a false twist textured polyester yarn; and, FIG. 4*c* shows a flat yarn. The irregularity of the crimp of the individual yarn fibrils is clearly evident from comparing FIG. 4*b* to FIGS. 4*a* and 4*c*.

Figure 5:
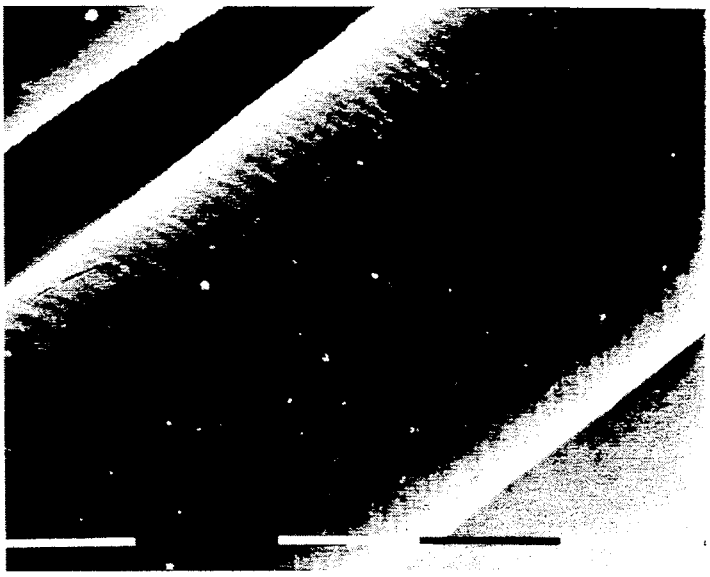
FIG. 5 is a photograph illustrating the characteristic surface structure of a yarn prepared in accordance with the present invention.

FIG. 5 shows a Scanning-Electronic-Microscope photograph of a yarn prepared in accordance with the present invention. The magnification of the yarn in FIG. 5 was 2100 : 1. The transverse surface lines, which result when practicing the process of this invention, are clear from this photograph.

EXAMPLES

The invention will be more fully explained by the following examples.

Example 1 (Three-step Process)

Here, a polyester-POY dtex 150 f 15 was manufactured at a speed of 3100 m/min. The drawing took place with a ratio of 1:1.93 at 652 m/min, and at room temperature, on a draw-twist machine.

Subsequently, the bobbins were shrunk in a shocking way on a fixing machine and a poststabilizing machine, respectively, while in a convection heater maintained at 200° C. The heat length was 63 cm.

The withdrawal speed of the yarn was at 110 m/min. The delivery speed varied between 154 m/min and 198 m/min. The lower limit (i.e., 154 m/min) corresponds to a 40% overfeed with a 28.6% shrinkage (see, FIG. 3, curve H); and the upper limit (i.e., 198 m/min) corresponds to an 80% overfeed with a 44.4% shrinkage (see, FIG. 3, curve I).

The properties of the yarn prepared in accordance with the aforementioned process are set out in Table 1, below.

TABLE 1

| | 40% overfeed | 80% overfeed |
|---|---|---|
| Secant modulus "S" (%) | 46.4 ($H_1$) | 11.3 ($I_1$) |
| Breaking stress (N) | 3.7 | 3.4 |
| Breaking elongation (%) | 72 | 107 |
| Boiling shrinkage at 98% C (%) | 0.2 | +1.8 |
| Hot shrinkage at 160° C. (%) | +4.3 | +11.0 |

+ = extension

Example 2 (Two-step process)

Here, polyester-POY dtex 170 f 36 was manufactured at a speed of 3100 m/min. These bobbins were continuously cold-drawn and shrunk in a shocking way. The manufacturing conditions for this yarn are set out in Table 2, below.

TABLE 2

| | Variant A | Variant B |
|---|---|---|
| Entering in the draw-zone | 91 m/min | 229 m/min |
| Draw-ratio | 1:1.75 | 1:1.75 |
| Withdrawal rate | 160 m/min | 400 m/min |
| Convection heater: | | |
| Temperature of the shrinking zone | 220° C. | 220° C. |
| Length of the heater | 1.20 m | 1.20 m |
| Overfeed/Shrinkage | 60% / 37.5% | 60% / 37.5% |
| Winding rate | 100 m/min | 250 m/min |

The properties of the yarn prepared in accordance with this process are set out in Table 3, below.

TABLE 3

| | Variant A | Variant B |
|---|---|---|
| Secant modulus "S" (%) | 65.6 | 23.3 |
| Breaking stress (N) | 3.2 | 3.9 |
| Breaking elongation (%) | 67 | 92 |
| Boiling shrinkage at 98% C (%) | 1.2 | +2 |
| Hot shrinkage | +1.5 | +9 |

TABLE 3-continued

| | Variant A | Variant B |
|---|---|---|
| at 160° C. (%) | | |

+ = extension

The yarns prepared in accordance with the present invention are useful, for example, in knitting, weaving and warp-knitting processes. These yarns can also be twisted and/or sized for weaving warp use.

We claim:

1. A process for the manufacture of a crimped polyester yarn obtained from a polyester partially-oriented yarn, said process comprising:

(a) fabricating a partially-oriented polyester yarn by a speed-spun process, wherein said yarn is fabricated by being spun at speeds ranging from about 2,000 to about 5,000 meters per minute, (b) cooling said partially-oriented polyester yarn, (c) cold drawing said cooled partially-oriented polyester yarn, and (d) subjecting said cold-drawn partially-oriented polyester yarn to a thermal treatment, said thermal treatment being conducted under tensionless conditions or under controlled yarn overfeed conditions, said thermal treatment resulting in said cold drawn, partially-oriented polyester becoming crimped.

2. A process according to claim 1 wherein the thermal treatment is conducted under controlled yarn overfeed conditions.

3. A process according to claim 2 wherein the overfeed varies from about 20% to about 100%.

4. A process according to claim 3 wherein the overfeed varies from about 40% to about 80%.

5. A process according to claim 1 wherein the thermal treatment takes place in a shocking way.

6. A process according to claim 3 wherein the thermal treatment takes place in a shocking way.

7. A process according to claim 1 wherein said crimped polyester yarn has a secant modulus of 0–100% as determined by the stress versus strain curve for said yarn between 10% and 30% elongation.

8. A process according to claim 11 wherein the thermal treatment is carried out in air, vapor, or an inert liquid.

9. A process according to claim 8 wherein the thermal treatment is carried out in air, wherein said air is at a temperature of from about 80° C. to about 220° C.

10. A process according to claim 9 wherein the temperature of said air is from about 140° C. to about 220° C.

* * * * *